US010339852B2

(12) United States Patent
Kim et al.

(10) Patent No.: US 10,339,852 B2
(45) Date of Patent: Jul. 2, 2019

(54) DISPLAY PANEL AND DISPLAY APPARATUS INCLUDING THE SAME

(71) Applicant: SAMSUNG DISPLAY CO., LTD., Yongin-si, Gyeonggi-Do (KR)

(72) Inventors: Jinpil Kim, Suwon-si (KR); Jung-Won Kim, Seoul (KR); Jaesung Bae, Suwon-si (KR); Namjae Lim, Gwacheon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/621,346

(22) Filed: Jun. 13, 2017

(65) Prior Publication Data

US 2017/0365206 A1 Dec. 21, 2017

(30) Foreign Application Priority Data

Jun. 15, 2016 (KR) ..... 10-2016-0074435

(51) Int. Cl.
*G09G 3/20* (2006.01)

(52) U.S. Cl.
CPC ..... *G09G 3/2092* (2013.01); *G09G 3/20* (2013.01); *G09G 2300/0426* (2013.01); *G09G 2300/0465* (2013.01); *G09G 2310/027* (2013.01); *G09G 2310/0213* (2013.01);
(Continued)

(58) Field of Classification Search
CPC ..... G09G 3/2092; G09G 3/20; G09G 3/3648; G09G 3/3659; G09G 3/3677; G09G 3/0285; G09G 2300/0426; G09G 2300/0465; G09G 2300/0452; G09G 2300/0439; G09G 2310/0213; G09G 2310/0243; G09G 2310/0267; G09G 2310/027; G09G 2310/0275; G09G 2310/0202;
(Continued)

(56) References Cited

U.S. PATENT DOCUMENTS 6,323,871 B1 11/2001 Fujiyoshi et al.
8,416,380 B2 * 4/2013 Yamamoto ..... G02F 1/133753 349/108
8,681,083 B2 3/2014 Kang et al.
(Continued)

FOREIGN PATENT DOCUMENTS

KR 10-2013-0102186 9/2013
KR 10-2016-0023023 3/2016

*Primary Examiner* — Tom V Sheng
(74) *Attorney, Agent, or Firm* — F. Chau & Associates, LLC

(57) ABSTRACT

A display panel includes a plurality of pixels, data lines, gate lines, a gate driver and terminals. The plurality of pixels form a plurality of rows and columns. The plurality of data lines extend in a first direction parallel to the pixel columns. Each data line is connected to at least two adjacent pixels included in a single pixel row. The plurality of gate lines extend in a second direction parallel with the plurality of pixel rows. The gate lines each connect to at least one pixel included in a single pixel row. At least two gate lines are disposed between two adjacent pixel rows. The gate driver generates signals to drive the plurality of gate lines. The plurality of terminals receives the gate signals to transmit the gate signals to the plurality of gate lines. Some of the terminals connect with some gate lines having a cross-coupled structure.

20 Claims, 14 Drawing Sheets

(52) U.S. Cl.
CPC ..... *G09G 2310/0243* (2013.01); *G09G 2310/0267* (2013.01); *G09G 2310/0275* (2013.01)

(58) Field of Classification Search
CPC .... G09G 2310/0216; G09G 2310/0281; G02F 1/136286; G02F 1/134336
See application file for complete search history.

(56) References Cited

U.S. PATENT DOCUMENTS 9,405,158 B2 * 8/2016 Chang ..... G02F 1/134336
2007/0097072 A1 * 5/2007 Kim ..... G09G 3/3614 345/103
2009/0262054 A1 * 10/2009 Hsu ..... G09G 3/3648 345/87
2010/0085497 A1 * 4/2010 Chang ..... G09G 3/3648 349/37
2010/0328198 A1 * 12/2010 Tsubata ..... G09G 3/3659 345/87
2012/0068916 A1 * 3/2012 Tsubata ..... G02F 1/1362 345/94
2012/0092241 A1 * 4/2012 Shang ..... G09G 3/3648 345/96
2013/0057598 A1 * 3/2013 Iwamoto ..... G02F 1/136286 345/690
2013/0069921 A1 * 3/2013 Saitoh ..... G09G 3/3659 345/204
2015/0062109 A1 * 3/2015 Liao ..... G09G 5/02 345/212
2016/0231605 A1 * 8/2016 Yu ..... G02F 1/136286
2016/0275888 A1 * 9/2016 Chen ..... G09G 3/3614
2017/0131606 A1 * 5/2017 Yabuki ..... G02F 1/133345
2017/0154588 A1 * 6/2017 Du ..... G09G 3/3614
2017/0307948 A1 * 10/2017 Zeng ..... G02F 1/1368

* cited by examiner

DISPLAY PANEL AND DISPLAY APPARATUS INCLUDING THE SAME

CROSS-REFERENCE TO RELATED APPLICATION

This application claims priority under 35 U.S.C. § 119 from Korean Patent Application No. 10-2016-0074435, filed on Jun. 15, 2016 in the Korean Intellectual Property Office (KIPO), the contents of which are incorporated by reference herein.

1. Technical Field

The present disclosure generally relates to displaying images, and more particularly to display panels and display apparatuses including the display panels.

2. Discussion of the Related Art

A liquid crystal display apparatus is a type of flat panel display (FPD), which has been widely used in recent years. For example, FPDs may include, but are not limited to, a liquid crystal display (LCD), a plasma display panel (PDP) and an organic light emitting display (OLED).

A display apparatus includes a display panel in which a plurality of pixels are connected to respective gate lines and to respective data lines crossing the gate lines which are formed on the display panel. There are also circuits provided, for example, a gate driver circuit configured for outputting gate signals to the gate lines and a data driver circuit configured for outputting data signals to the data lines. Display panels designed with a reduced number of data lines tend to display a higher quality image and operate more reliably.

SUMMARY

Accordingly, at least one exemplary embodiment of the inventive concept provides a display panel capable of enhancing display quality without excessive design change.

At least one exemplary embodiment of the inventive concept provides a display apparatus including the display panel.

According to exemplary embodiments of the inventive concept, a display panel includes a plurality of pixels arranged in a matrix including a plurality of pixel rows and a plurality of pixel columns, in which each pixel of the plurality of pixels has a short side and a long side that is longer than the short side; a plurality of data lines extending in a first direction substantially parallel with the plurality of pixel columns along the short side of the pixels, each of the data lines is connected to at least two adjacent pixels included in a single pixel row. The plurality of gate lines extend in a second direction parallel with the plurality of pixel rows. Each of the gate lines is connected to at least one pixel included in a single pixel row. At least two of the gate lines are disposed between two adjacent pixel rows. The gate driver generates a plurality of gate signals for driving the plurality of gate lines. A plurality of terminals receive the plurality of gate signals to transmit the plurality of gate signals to the plurality of gate lines. Some of the terminals are connected to some of the gate lines with a cross-coupled structure.

In an exemplary embodiment of the inventive concept, the plurality of gate lines may include, for example, first, second, third, fourth, fifth and sixth gate lines that are sequentially arranged in the first direction. The plurality of terminals may include first, second, third, fourth, fifth and sixth terminals that sequentially receive first, second, third, fourth, fifth and sixth gate signals among the plurality of gate signals, respectively. The first terminal may be connected to the first gate line, the second terminal may be connected to the third gate line, the third terminal may be connected to the fifth gate line, the fourth terminal may be connected to the second gate line, the fifth terminal may be connected to the fourth gate line, and the sixth terminal may be connected to the sixth gate line.

In an exemplary embodiment of the inventive concept, the display panel may further include a first connection pattern, a second connection pattern, a third connection pattern, a fourth connection pattern, a fifth connection pattern and a sixth connection pattern. The first connection pattern may connect, for example, the first terminal with the first gate line. The second connection pattern may connect the second terminal with the third gate line. The third connection pattern may connect a wiring connected to the third terminal with the fifth gate line. The fourth connection pattern may connect the fourth terminal with the second gate line. The fifth connection pattern may connect the fifth terminal with the fourth gate line. The sixth connection pattern may connect the sixth terminal with the sixth gate line. The second connection pattern may overlap the second gate line, and the fourth and fifth connection patterns may overlap the wiring connected to the third terminal.

In an exemplary embodiment of the inventive concept, the plurality of pixels may include first and second pixels, third and fourth pixels, and fifth and sixth pixels. The first and second pixels may be adjacent to each other, may be included in a first pixel row among the plurality of pixel rows, and may be connected to the first and second gate lines, respectively. The arrangement of, for example, the third and fourth pixels may be adjacent to each other, may be adjacent to the first and second pixels, may be included in a second pixel row adjacent to the first pixel row among the plurality of pixel rows, and may be connected to the third and fourth gate lines, respectively. The fifth and sixth pixels, for example, may be adjacent to each other, may be adjacent to the third and fourth pixels, may be included in a third pixel row adjacent to the second pixel row from among the plurality of pixel rows, and may be connected to the fifth and sixth gate lines, respectively.

In an exemplary embodiment of the inventive concept, during a first frame period for displaying a first frame image, the first through sixth gate signals may be sequentially activated, for example, in an order of the first, second, third, fourth, fifth and sixth gate signals, and the first through sixth pixels may be sequentially driven, for example, in an order of the first, third, fifth, second, fourth and sixth pixels based on the activated first through sixth gate signals.

In an exemplary embodiment of the inventive concept, the first through sixth gate signals may have an ON level during at least two consecutive or successive horizontal periods, and activation periods of the first through sixth gate signals may partially overlap each other. In another exemplary embodiment, the ON level comprises at least six consecutive or horizontal periods.

In an exemplary embodiment of the inventive concept, the activation periods of the first through sixth gate signals may partially overlap each other.

In an exemplary embodiment of the inventive concept, during a second frame period for displaying a second frame image after the first frame period, the first through sixth gate signals may be sequentially activated, for example, in an order of the fourth, fifth, sixth, first, second and third gate signals, and the first through sixth pixels may be sequentially driven, for example, in an order of the second, fourth, sixth, first, third and fifth pixels based on the activated first through sixth gate signals.

In an exemplary embodiment of the inventive concept, the second and third gate lines may be disposed between the first and second pixel rows. The fourth and fifth gate lines may be disposed between the second and third pixel rows.

In an exemplary embodiment of the inventive concept, the first and second gate lines may be disposed between the first and second pixel rows. The third and fourth gate lines may be disposed between the second and third pixel rows.

In an exemplary embodiment of the inventive concept, the plurality of data lines may include first and second data lines that are adjacent to each other. The first, second, fifth and sixth pixels may be connected to the first data line, and the third and fourth pixels may be connected to the second data line.

In an exemplary embodiment of the inventive concept, the plurality of gate lines may include first through 6*n gate lines that are sequentially arranged in the first direction, where n is a natural number equal to or greater than two. The plurality of terminals may include, for example, first through 6*n terminals that sequentially receive first through 6*n gate signals among the plurality of gate signals, respectively. A k-th terminal among the first through 6*n terminals may be connected to a (2k−1)-th gate line, where k is a natural number equal to or greater than one and equal to or less than 3*n. A m-th terminal among the first through 6*n terminals may be connected to a 2*(m−3n)-th gate line, where m is a natural number equal to or greater than (3n+1) and equal to or less than 6*n.

In an exemplary embodiment of the inventive concept, the plurality of pixels may be disposed in a display region of the display panel. In addition, the gate driver and the plurality of terminals may be disposed in a peripheral region surrounding the display region of the display panel.

According to exemplary embodiments of the inventive concept, a display apparatus includes a gate driver and a display panel. The gate driver may generate a plurality of gate signals. The display panel is connected to the gate driver. The display panel includes a plurality of pixels, a plurality of data lines, a plurality of gate lines and a plurality of terminals. The plurality of pixels are arranged to form a plurality of pixel rows and a plurality of pixel columns. The plurality of data lines may extend in a first direction parallel with the plurality of pixel columns. Each of the data lines may be connected to at least two adjacent pixels included in a single pixel row. The plurality of gate lines extend in a second direction parallel with the plurality of pixel rows and are driven by the plurality of gate signals. Each of the gate lines is connected to at least one pixel included in a single pixel row. At least two of the gate lines may be disposed between two adjacent pixel rows. The plurality of terminals receives the plurality of gate signals to transmit the plurality of gate signals to the plurality of gate lines. Some of the terminals may be connected to some of the gate lines with a cross-coupled structure.

In an exemplary embodiment of the inventive concept, the plurality of gate lines may include first, second, third, fourth, fifth and sixth gate lines that are sequentially arranged in the first direction. The plurality of terminals may include, for example, first, second, third, fourth, fifth and sixth terminals that sequentially receive first, second, third, fourth, fifth and sixth gate signals among the plurality of gate signals, respectively. The first terminal may be connected to the first gate line, the second terminal may be connected to the third gate line, the third terminal may be connected to the fifth gate line, the fourth terminal may be connected to the second gate line, the fifth terminal may be connected to the fourth gate line, and the sixth terminal may be connected to the sixth gate line.

In an exemplary embodiment of the inventive concept, the display panel may further include a first connection pattern, a second connection pattern, a third connection pattern, a fourth connection pattern, a fifth connection pattern and a sixth connection pattern.

The first connection pattern may connect the first terminal with the first gate line. The second connection pattern may connect the second terminal with the third gate line. The third connection pattern may connect a wiring connected to the third terminal with the fifth gate line. The fourth connection pattern may connect the fourth terminal with the second gate line. The fifth connection pattern may connect the fifth terminal with the fourth gate line. The sixth connection pattern may connect the sixth terminal with the sixth gate line. The second connection pattern may overlap the second gate line, and the fourth and fifth connection patterns may overlap the wiring connected to the third terminal.

In an exemplary embodiment of the inventive concept, the plurality of pixels may include first and second pixels, third and fourth pixels, and fifth and sixth pixels. The first and second pixels may be adjacent to each other, may be included in a first pixel row among the plurality of pixel rows, and may be connected to the first and second gate lines, respectively. The third and fourth pixels may be adjacent to each other, may be adjacent to the first and second pixels, may be included in a second pixel row adjacent to the first pixel row among the plurality of pixel rows, and may be connected to the third and fourth gate lines, respectively. The fifth and sixth pixels may be adjacent to each other, may be adjacent to the third and fourth pixels, may be included in a third pixel row adjacent to the second pixel row among the plurality of pixel rows, and may be connected to the fifth and sixth gate lines, respectively.

In an exemplary embodiment of the inventive concept, during a first frame period for displaying a first frame image, the first through sixth gate signals may be sequentially activated in an order of the first, second, third, fourth, fifth and sixth gate signals, and the first through sixth pixels may be sequentially driven in an order of the first, third, fifth, second, fourth and sixth pixels based on the activated first through sixth gate signals.

In an exemplary embodiment of the inventive concept, during a second frame period for displaying a second frame image after the first frame period, the first through sixth gate signals may be sequentially activated in an order of the fourth, fifth, sixth, first, second and third gate signals, and the first through sixth pixels may be sequentially driven in an order of the second, fourth, sixth, first, third and fifth pixels based on the activated first through sixth gate signals.

In an exemplary embodiment of the inventive concept, the second and third gate lines may be disposed between the first and second pixel rows, and the fourth and fifth gate lines may be disposed between the second and third pixel rows. Or, the first and second gate lines may be disposed between the first and second pixel rows, and the third and fourth gate lines may be disposed between the second and third pixel rows.

In an exemplary embodiment of the inventive concept, the plurality of gate lines may include first through 6*n gate lines that are sequentially arranged in the first direction, where n is a natural number equal to or greater than two. The plurality of terminals may include first through 6*n terminals that sequentially receive first through 6*n gate signals among the plurality of gate signals, respectively. A k-th terminal among the first through 6*n terminals may be connected to a (2k−1)-th gate line, where k is a natural number equal to or greater than one and equal to or less than 3*n. A m-th terminal among the first through 6*n terminals may be connected to a 2*(m−3n)-th gate line, where m is a natural number equal to or greater than (3n+1) and equal to or less than 6*n.

In an exemplary embodiment of the inventive concept, a display panel may include a plurality of pixels in which each pixel has a first side comprising a short-side and a second side comprising a long-side substantially perpendicular to the short side, the plurality of pixels arranged in matrix including a plurality of pixel rows and a plurality of pixel columns; a plurality of data lines extending substantially parallel to a short-side direction of the pixels, and each of the data lines is connected to at least two adjacent pixels in one of the plurality of pixel rows; and a plurality of gate lines extending substantially parallel to a long-side direction of the pixels, each of the gate lines is connected to at least one pixel included in a single pixel row, and at least two of the gate lines are disposed between two adjacent pixel rows.

In an exemplary embodiment of the inventive concept, a plurality of terminals may be configured to receive a plurality of gate signals to transmit a plurality of gate signals to the plurality of gate lines, wherein one or more of the plurality of terminals is connected respectively with one of the plurality of gate lines with a cross-coupled structure.

In an exemplary embodiment of the inventive concept, the plurality of gate lines may include at least six gate lines that are sequentially arranged in the short-side direction.

In the display panel and the display apparatus according to exemplary embodiments of the inventive concepts, the data lines may extend in a direction parallel with a short side of each pixel, and thus the number of the data lines may be reduced. In addition, a single data line may be shared by at least two adjacent pixels included in a single pixel row, and thus the number of the data lines may also be reduced. Further, in the display panel and the display apparatuses having a configuration of reducing the number of the data lines, some of the terminals may be connected to some of the gate lines with a cross-coupled structure, and thus a driving order of the gate lines may be efficiently changed without excessive design change.

BRIEF DESCRIPTION OF THE DRAWINGS

Illustrative, non-limiting exemplary embodiments of the inventive concept will be more clearly understood from the following detailed description taken in conjunction with the accompanying drawings.

DETAILED DESCRIPTION

Figure 1:
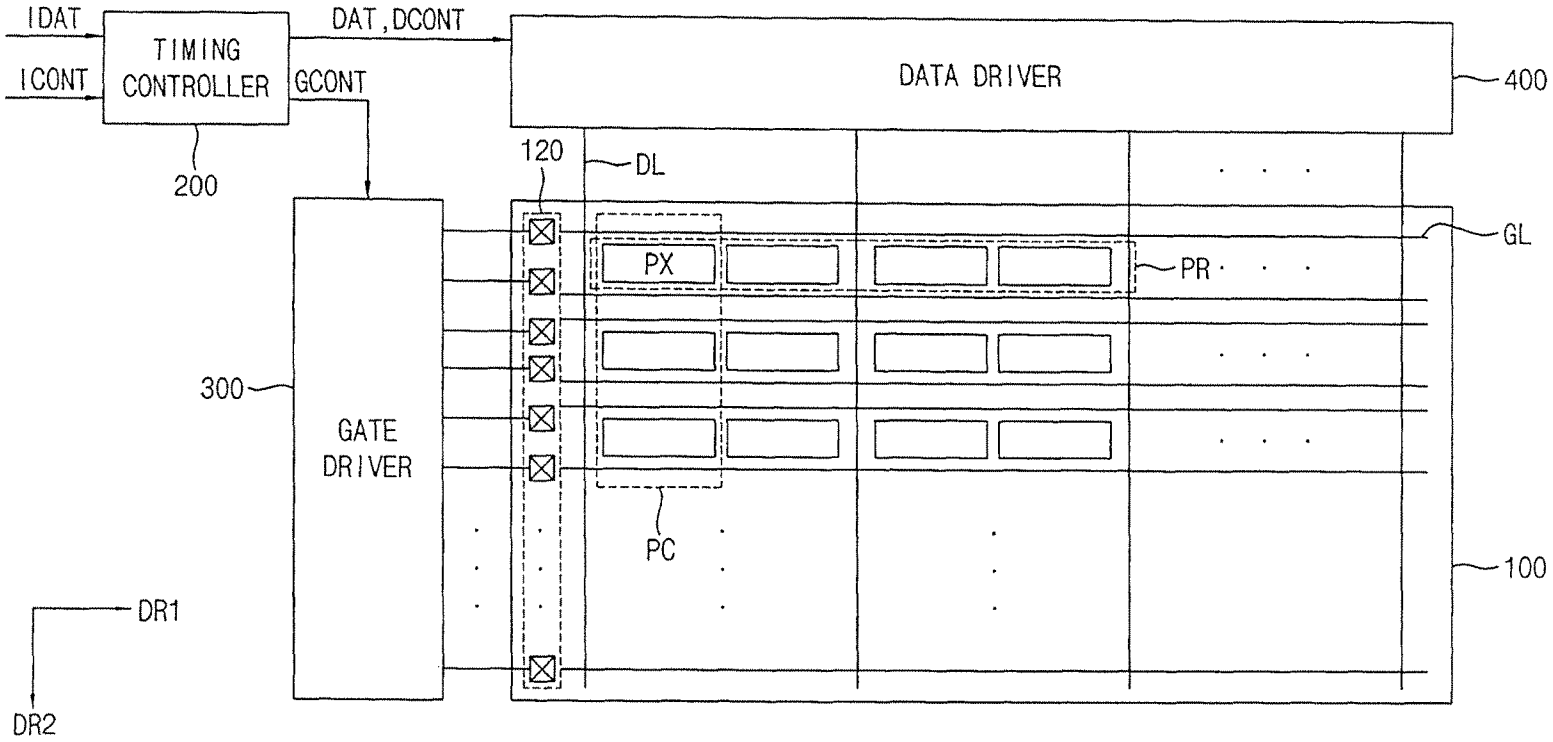
FIGS. 1 and 2 are block diagrams illustrating a display apparatus according to exemplary embodiments of the inventive concept in which FIG. 2 additionally includes the gate driver of FIG. 1 arranged in the display panel, and the display apparatus FIG. 2 further includes two PCBs.

Various exemplary embodiments of the inventive concept will be described more fully with reference to the accompanying drawings, in which embodiments are shown. This inventive concept may, however, be embodied in many different forms and should not be construed as limited to the embodiments set forth herein. Like reference numerals refer to like elements throughout this application.

Figure 2:
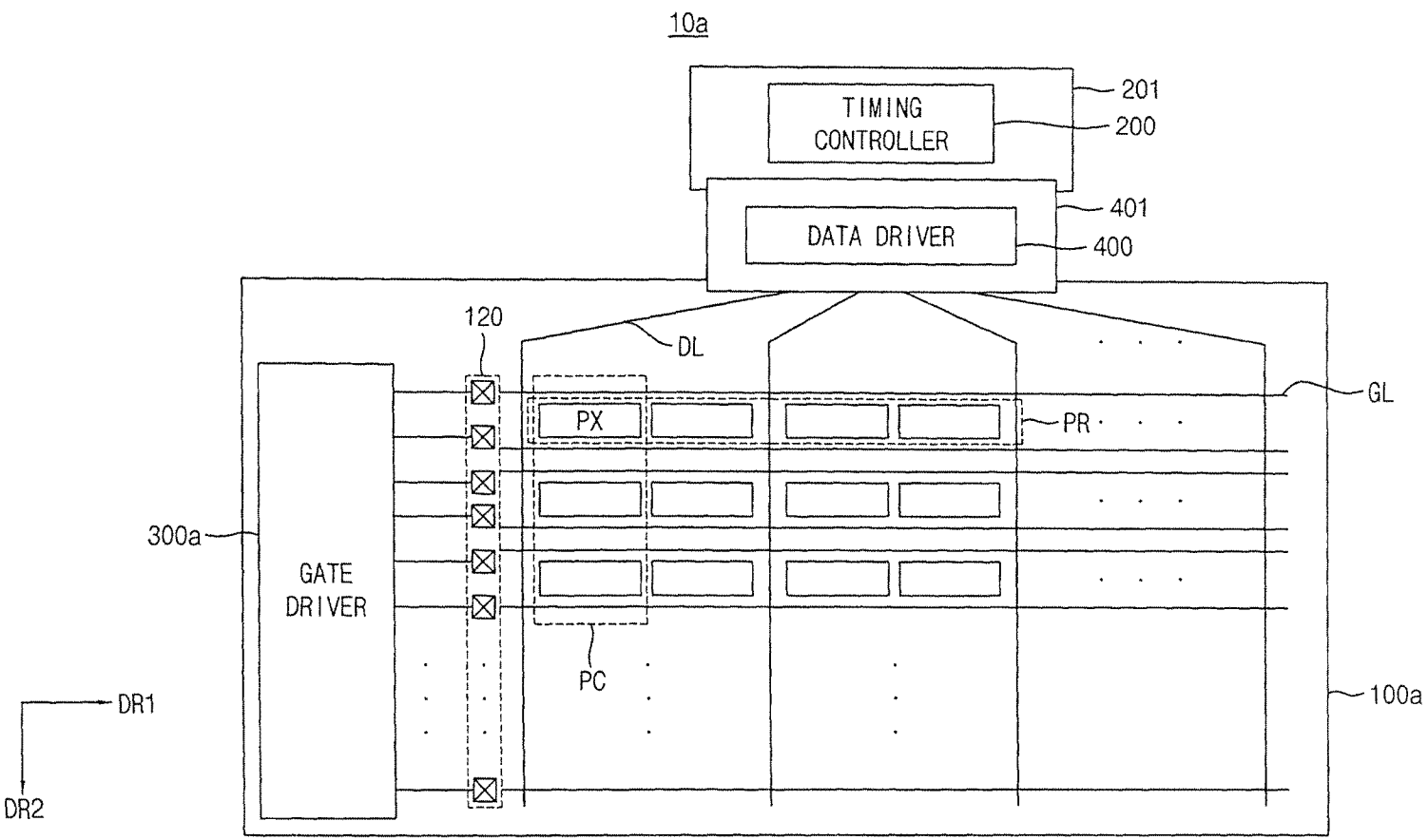

FIGS. 1 and 2 are block diagrams illustrating a display apparatus according to exemplary embodiments of the inventive concept.

Referring to FIG. 1, a display apparatus 10 may include a display panel 100, a timing controller 200, a gate driver 300 and a data driver 400.

The display panel 100 operates (e.g., display an image) based on output image data DAT. The display panel 100 includes a plurality of pixels PX, a plurality of data lines DL, a plurality of gate lines GL and a plurality of terminals 120.

The plurality of pixels PX are arranged to form a plurality of pixel rows PR and a plurality of pixel columns PC. For example, the plurality of pixels PX may be arranged in a matrix form, as shown in FIG. 1. Each of the pixel rows PR is formed (e.g., may extend) in a first direction DR1, and each of the pixel columns PC is formed (e.g., may extend) in a second direction DR2 crossing (e.g., substantially perpendicular to) the first direction DR1. For example, the first direction DR1 may be parallel with a relatively long side of each pixel, and may be referred to as a "long-side" direction of each pixel. The second direction DR2 may be parallel with a relatively short side of each pixel, and may be referred to as a "short-side" direction of each pixel. Each of the pixels PX may be electrically connected to a respective one of the gate lines GL and a respective one of the data lines DL.

With continued reference to FIG. 1, each of the plurality of data lines DL extends in the second direction DR2 that is parallel with the plurality of pixel columns PC. The plurality of data lines DL are driven by a plurality of data voltages that are generated from the data driver 400. Each of the data lines DL is connected to at least two adjacent pixels included in a single pixel row. For example, the plurality of data lines DL may be arranged for each of at least two pixel columns per data line. A single data line may be shared by at least two adjacent pixels in a single pixel row, and then at least two adjacent pixels in a single pixel row may receive data voltages through a single data line.

Each of the plurality of gate lines GL extends in the first direction DR1 parallel with the plurality of pixel rows PR.

The plurality of gate lines GL are driven by a plurality of gate signals that are generated from the gate driver 300. For example, each of the gate lines GL is connected to at least one pixel included in a single pixel row, and at least two of the gate lines GL are disposed between two adjacent pixel rows. For example, pixels included in a single pixel row may be connected to at least two adjacent gate lines, and then may receive gate signals through at least two adjacent gate lines.

The plurality of terminals 120 receive the plurality of gate signals from the gate driver 300 to transmit the plurality of gate signals to the plurality of gate lines GL. Each of the terminals 120 is electrically connected to a respective one of the gate lines GL, and some of the terminals 120 are connected to some of the gate lines GL with a cross-coupled structure. The cross-coupled structure according to exemplary embodiments will be described with reference to FIGS. 3, 4A, 4B and other example figures.

In some exemplary embodiments of the inventive concept, the plurality of pixels PX may be disposed in a display region of the display panel 100, and the plurality of terminals 120 may be disposed in a peripheral region of the display panel 100. The peripheral region may partially or fully surround the display region. For example, the plurality of terminals 120 may be disposed in the peripheral region of the display panel, and may be adjacent to a first side (e.g., a relatively short side on the left) of the display panel 100.

The timing controller 200 controls an operation of the display panel 100, the gate driver 300 and the data driver 400. The timing controller 200 receives an input image data IDAT and an input control signal ICONT from an external device (e.g., a host or a graphic processor). The input image data IDAT may include a plurality of pixel data for the plurality of pixels PX. The input control signal ICONT may include a master clock signal, a data enable signal, a vertical synchronization signal, a horizontal synchronization signal, etc.

The timing controller 200, for example, may generate the output image data DAT based on the input image data IDAT. For example, the timing controller 200 may selectively perform an image quality compensation, a spot compensation, an adaptive color correction (ACC), and/or a dynamic capacitance compensation (DCC) on the input image data IDAT to generate the output image data DAT. The timing controller 200 may generate a first control signal GCONT and a second control signal DCONT based on the input control signal ICONT. For example, the first control signal GCONT may include, for example, a vertical start signal, a gate clock signal, etc. The second control signal DCONT may include, for example, a horizontal start signal, a data clock signal, a polarity control signal, a data load signal, etc.

With continued reference to FIG. 1, the gate driver 300 generates the plurality of gate signals for driving the gate lines GL based on the first control signal GCONT. For example, the gate driver 300 may sequentially provide the gate signals to the display panel 100 through the gate lines GL. For example, the gate driver 300 may include structure such as a memory, e.g., a plurality of shift registers.

The data driver 400 generates the plurality of data voltages (e.g., analog voltages) for driving the data lines DL based on the output image data DAT (e.g., digital data) and the second control signal DCONT. For example, the data driver 400 may sequentially provide the data voltages to a plurality of lines (e.g., horizontal lines) in the display panel 100 through the data lines DL. For example, the data driver 400 may include structure such as a shift register, a data latch, an analog-to-digital converter and an output buffer.

Referring to FIG. 2, a display apparatus 10*a* may include a display panel 100*a*, a timing controller 200, a gate driver 300*a* and a data driver 400. The display apparatus 10*a* may further include a printed circuit board (PCB) 201 and/or a flexible PCB (FPCB) 401.

The display apparatus 10*a* of FIG. 2 may be substantially similar to the display apparatus 10 of FIG. 1. However, the gate driver 300*a* in FIG. 2 is included in the display panel 100*a* in FIG. 2, and the display apparatus 10*a* of FIG. 2 further includes, for example, the PCB 201 and the FPCB 401.

The gate driver 300*a* may be an amorphous silicon gate (ASG) unit that is integrated in the display panel 100*a*. In some exemplary embodiments, the plurality of pixels PX may be disposed in a display region of the display panel 100*a*, and the gate driver 300*a* and the plurality of terminals 120 may be disposed in a peripheral region of the display panel 100*a*. The peripheral region may surround the display region. For example, the gate driver 300*a* may be disposed in the peripheral region, and may be adjacent to a first side (e.g., a relatively short side on the left) of the display panel 100*a*. The plurality of terminals 120 may be disposed in peripheral region between the gate driver 300*a* and the display region.

The timing controller 200 may be mounted, for example, on the PCB 201. The data driver 400 may be mounted on the FPCB 401. The FPCB 401 may electrically connect the PCB 201 with the display panel 100*a*. For example, the PCB 201 and the FPCB 401 may be electrically connected by an anisotropic conductive film (ACF), and the FPCB 401 and the display panel 100*a* may be electrically connected by the ACF. For example, the FPCB 401 may be adjacent to a second side (e.g., a relatively long side on the upper) of the display panel 100*a* crossing the first side of the display panel 100*a*. In other words, the data driver 400 may be connected to the display panel 100*a* in a tape carrier package (TCP) type.

Although FIG. 2 illustrates an example where the display apparatus 10*a* includes a single data driver chip and a single FPCB 401, a display apparatus according to exemplary embodiments of the inventive concept may include a plurality of data driver chips. For example, where the display apparatus includes a plurality of data driver chips, the number of the FPCBs on which at least one data driver chip is mounted may be equal to or less than the number of the data driver chips.

Although not illustrated in FIG. 2, the data driver 400 may also be mounted on or integrated in the display panel 100*a*.

In the display apparatuses 100 and 100*a* according to exemplary embodiments, shown in FIGS. 1 and 2, the data lines DL may extend in a direction parallel with a short side of each pixel, and thus the number of the data lines DL may be reduced. In addition, a single data line may be shared by at least two adjacent pixels included in a single pixel row, and thus the number of the data lines DL may also be reduced. Further, in the display apparatuses 100 and 100*a* that have a configuration of reducing the number of the data lines DL, and some of the terminals 120 may be connected to some of the gate lines GL with a cross-coupled structure, and thus a driving order of the gate lines GL may be efficiently changed without excessive design change.

Figure 3:
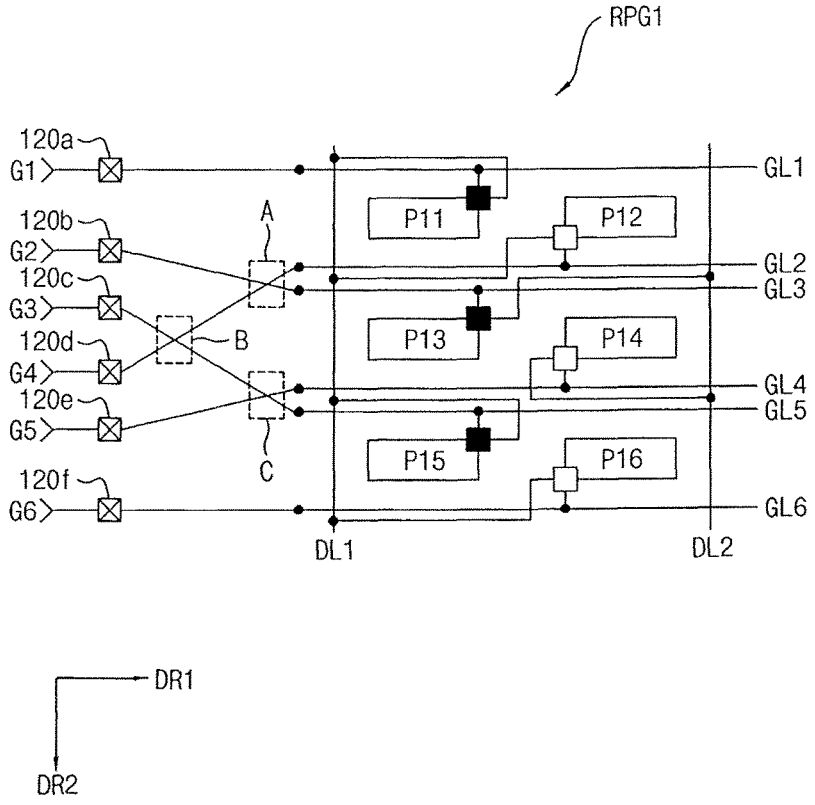
FIG. 3 is a diagram illustrating an example of a portion of a display panel according to exemplary embodiments of the inventive concept.

FIG. 3 is a diagram illustrating an example of a portion of a display panel according to an exemplary embodiment of the inventive concept.

Referring to FIG. 3, a display panel may include, for example, first, second, third, fourth, fifth and sixth gate lines GL1, GL2, GL3, GL4, GL5 and GL6, first and second data lines DL1 and DL2, first, second, third, fourth, fifth and sixth pixels P11, P12, P13, P14, P15 and P16, and first, second, third, fourth, fifth and sixth terminals 120*a*, 120*b*, 120*c*, 120*d*, 120*e* and 120*f*. The first through sixth pixels P11~P16 may form a first repeating pixel group RPG1.

Each of the first through sixth gate lines GL1~GL6 may extend in a first direction DR1 (see FIG. 3). The first through sixth gate lines GL1~GL6 may be adjacent to each other, and may be sequentially arranged in a second direction DR2. Each of the first and second data lines DL1 and DL2 may extend in the second direction DR2. The first and second data lines DL1 and DL2 may be adjacent to each other, and may be sequentially arranged in the first direction DR1.

Each of the first through sixth pixels P11-P16 may be included in a respective one pixel row and a respective one pixel column. For example, the first and second pixels P11 and P12 may be included in a first pixel row, and may be adjacent to each other. The third and fourth pixels P13 and P14 may be included in a second pixel row, and may be adjacent to each other. The fifth and sixth pixels P15 and P16 may be included in a third pixel row, and may be adjacent to each other. With the aforementioned arrangement, the second pixel row may be adjacent to the first pixel row, and the third pixel row may be adjacent to the second pixel row. The first, third and fifth pixels P11, P13 and P15 may be included in a first pixel column. The second, fourth and sixth pixels P12, P14 and P16, for example, may be included in a second pixel column that is adjacent to the first pixel column.

Each of the first through sixth pixels P11~P16 may be electrically connected to a respective one of the first through sixth gate lines GL1~GL6 and a respective one of the first and second data lines DL1 and DL2. For example, the first and second pixels P11 and P12 may be electrically connected to the first data line DL1, and may be electrically connected to the first and second gate lines GL1 and GL2, respectively. The third and fourth pixels P13 and P14 may be electrically connected to the second data line DL2, and may be electrically connected to the third and fourth gate lines GL3 and GL4, respectively. The fifth and sixth pixels P15 and P16 may be, for example, electrically connected to the first data line DL1, and may be electrically connected to the fifth and sixth gate lines GL5 and GL6, respectively.

The first and second gate lines GL1 and GL2 may be connected to the pixels P11 and P12 that are included in the first pixel row. The first gate line GL1 may be disposed at a first side (e.g., an upper side) with respect to the first pixel row, and the second gate line GL2 may be disposed at a second side (e.g., a lower side) with respect to the first pixel row. In this example, the first gate line GL1 may be referred to as a "top gate line" of the first pixel row, and the second gate line GL2 may be referred to as a "bottom gate line" of the first pixel row. Similarly, the third and fourth gate lines GL3 and GL4 may be referred to as a top gate line of the second pixel row and a bottom gate line of the second pixel row, respectively, and the fifth and sixth gate lines GL5 and GL6 may be referred to as a top gate line of the third pixel row and a bottom gate line of the third pixel row, respectively.

In some exemplary embodiments of the inventive concept, the second and third gate lines GL2 and GL3 may be disposed between the first and second pixel rows, and the fourth and fifth gate lines GL4 and GL5 may be disposed between the second and third pixel rows.

In FIG. 3, each of black squares (■) that overlap the first, third and fifth pixels P11, P13 and P15 may represent a switching element (e.g., a transistor) connected to the top gate line, and each of white squares (□) that overlap the second, fourth and sixth pixels P12, P14 and P16 may represent a switching element connected to the bottom gate line. In an example of FIG. 3, the switching elements (e.g., ■ and □) may be arranged between the first and second pixel columns, and thus lengths of wirings that connect the switching elements with the data lines DL1 and DL2 may be substantially the same as each other.

The first through sixth terminals 120*a*~120*f* may sequentially receive first, second, third, fourth, fifth and sixth gate signals G1, G2, G3, G4, G5 and G6. Similar to the first through sixth gate lines GL1-GL6, the first through sixth terminals 120*a*~120*f* may be sequentially arranged in the second direction DR2.

In some exemplary embodiments, the first terminal 120*a* may be connected to the first gate line GL1, the second terminal 120*b* may be connected to the third gate line GL3, the third terminal 120*c* may be connected to the fifth gate line GL5, the fourth terminal 120*d* may be connected to the second gate line GL2, the fifth terminal 120*e* may be connected to the fourth gate line GL4, and the sixth terminal 120*f* may be connected to the sixth gate line GL6. In other words, the middle terminals 120*b*~120*e* other than the first and last terminals 120*a* and 120*f* may be cross-coupled to the middle gate lines GL2~GL5 other than the first and last gate lines GL1 and GL6. In an example of FIG. 3, three wiring overlapping regions A, B and C may be formed by the cross-coupled structure.

Based on the cross-coupled structure in FIG. 3, the first gate signal G1 may be applied to the first gate line GL1, the second gate signal G2 may be applied to the third gate line GL3, the third gate signal G3 may be applied to the fifth gate line GL5, the fourth gate signal G4 may be applied to the second gate line GL2, the fifth gate signal G5 may be applied to the fourth gate line GL4, and the sixth gate signal G6 may be applied to the sixth gate line GL6.

In some exemplary embodiments, each of the first and second pixels P11 and P12 may be a red pixel outputting red light, each of the third and fourth pixels P13 and P14 may be a green pixel outputting green light, and each of the fifth and sixth pixels P15 and P16 may be a blue pixel outputting blue light.

In some exemplary embodiments, the first repeating pixel group RPG1 may be repeated in the first and second directions DR1 and DR2 to form the display panel according to exemplary embodiments. In other exemplary embodiments, a second repeating pixel group in which the first, second, fifth and sixth pixels P11, P12, P15 and P16 are connected to the second data line DL2, and the third and fourth pixels P13 and P14 are connected to the first data line DL1 may exist, and then the first repeating pixel group RPG1 and the second repeating pixel group may be alternately repeated in the first and second directions DR1 and DR2 to form the display panel according to exemplary embodiments. In the display panel according to exemplary embodiments, the connection of the terminals 120*a*~120*f* with the gate lines GL1~GL6 in FIG. 3 may be repeated for each of six gate lines.

Figure 4A:
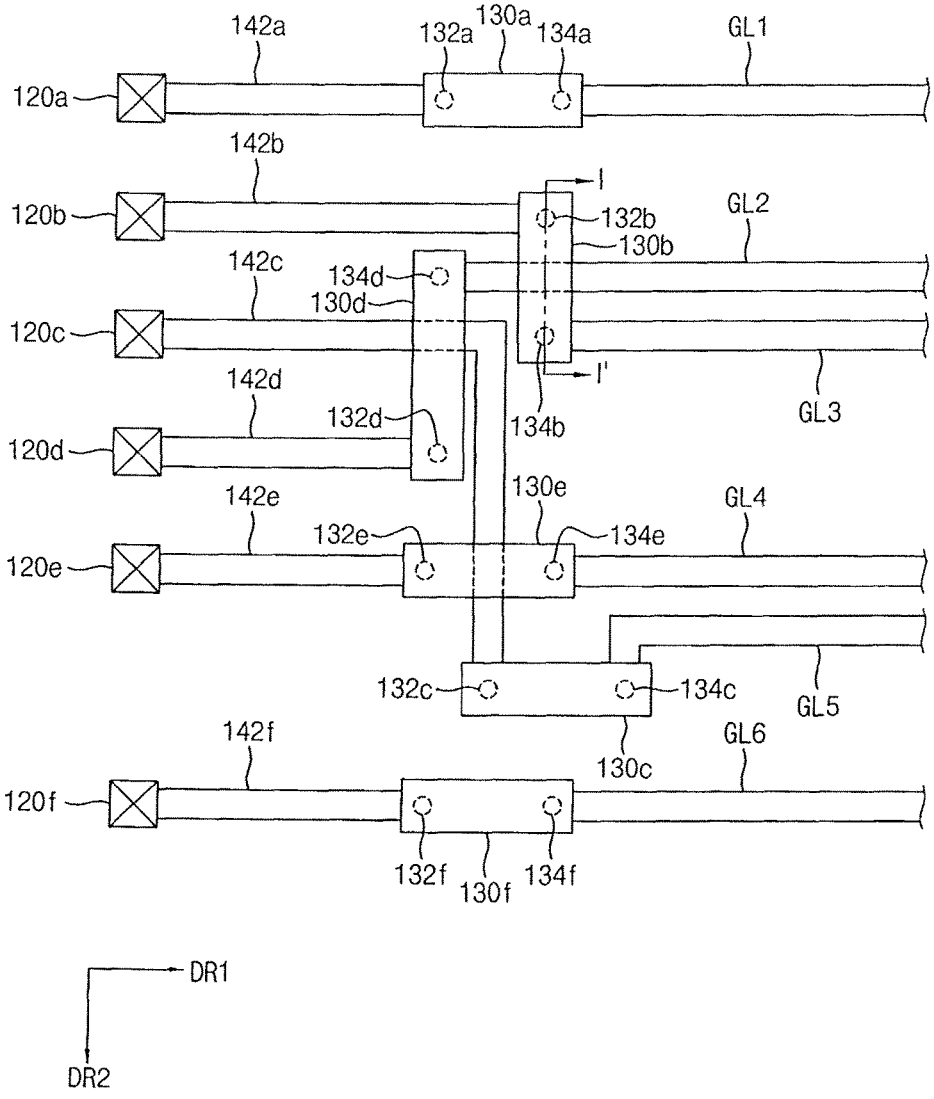
FIG. 4A is a plan view of an example of a connection structure of the terminals of a display panel with the gate lines in FIG. 3.
Figure 4B:
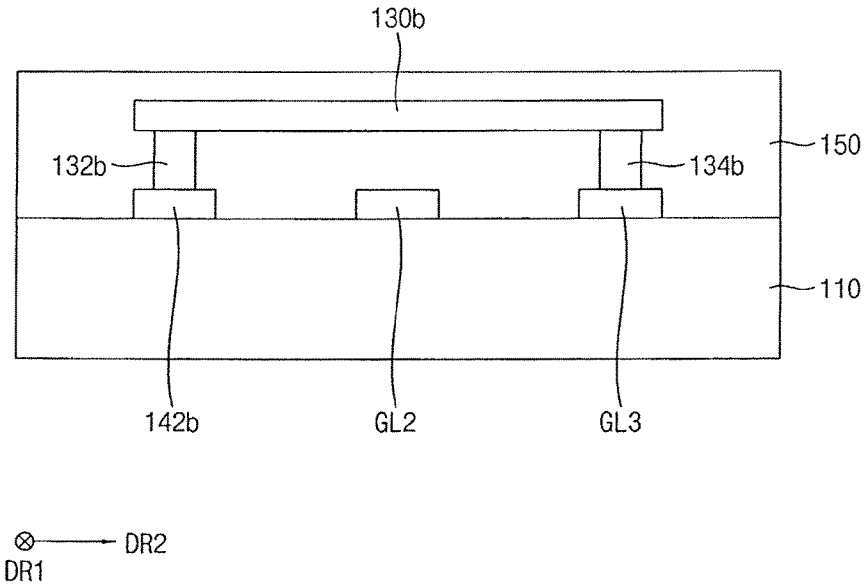
FIG. 4B is a cross-sectional view taken along line I-I' in FIG. 4A.
Figure 5A:
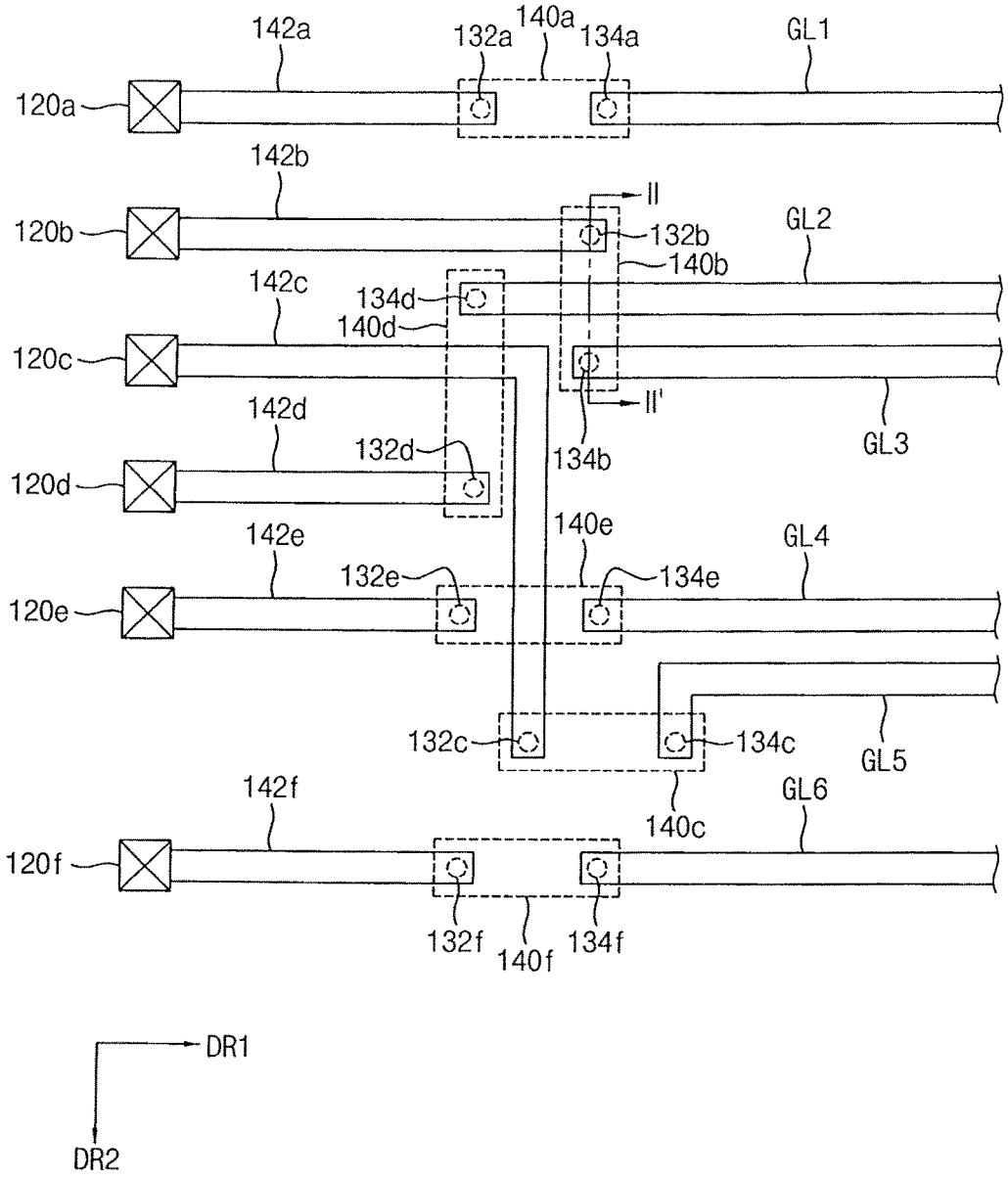
FIG. 5A is a plan view of another example of a connection structure of the terminals of a display panel with the gate lines in FIG. 3.
Figure 5B:
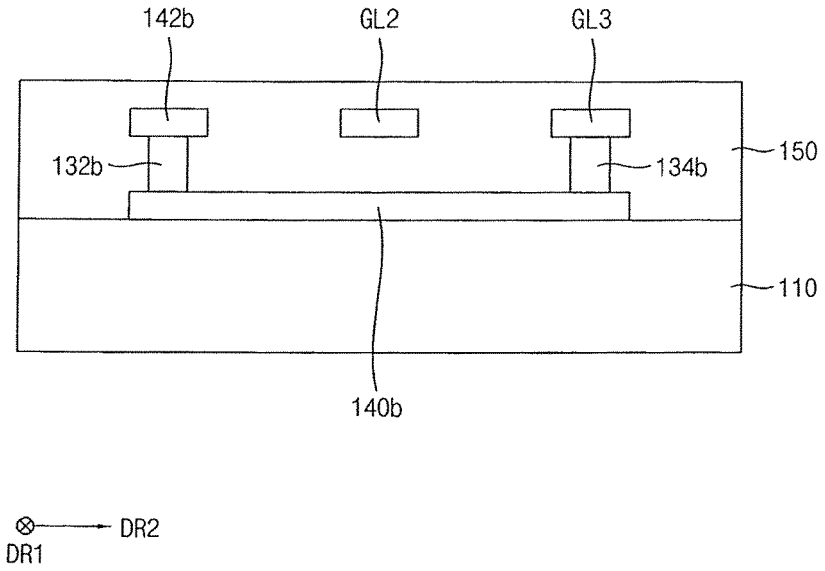
FIG. 5B is a cross-sectional view taken along line II-II' in FIG. 5A.

FIGS. 4A, 4B, 5A and 5B provide diagrams to illustrate a connection structure of a display panel according to exemplary embodiments. FIG. 4A is a plan view of an example of a connection of the terminals with the gate lines in FIG. 3. FIG. 4B is a cross-sectional view taken along line I-I' in FIG. 4A. FIG. 5A is a plan view of another example of a connection of the terminals with the gate lines in FIG. 3. FIG. 5B is a cross-sectional view taken along line II-II' in FIG. 5A. For convenience of illustration, elements other than wirings and patterns are omitted in FIGS. 4A and 5A.

Referring now to FIGS. 4A and 4B, the display panel may include the first through sixth gate lines GL1~GL6 and the first through sixth terminals 120*a*~120*f*. The display panel may further include first, second, third, fourth, fifth and sixth connection patterns 130*a*, 130*b*, 130*c*, 130*d*, 130*e* and 130*f*, first, second, third, fourth, fifth and sixth wirings 142*a*, 142*b*, 142*c*, 142*d*, 142*e* and 142*f*, and contacts 132*a*, 132*b*, 132*c*, 132*d*, 132*e*, 132*f*, 134*a*, 134*b*, 134*c*, 134*d*, 134*e* and 134*f*.

As shown in FIG. 4A, each of the first through sixth wirings 142*a*~142*f* may be electrically connected to a respective one of the first through sixth terminals 120*a*~120*f*.

Each of the first through sixth connection patterns 130*a*~130*f* may electrically connect a respective one of the first through sixth terminals 120*a*~120*f* with a respective one of the first through sixth gate lines GL1~GL6. For example, the first connection pattern 130*a* may electrically connect the first terminal 120*a* with the first gate line GL1, and may be electrically connected to the first wiring 142*a* and the first gate line GL1 through the contacts 132*a* and 134*a*, respectively. The second connection pattern 130*b* may electrically connect the second terminal 120*b* with the third gate line GL3, and may be electrically connected to the second wiring 142*b* and the third gate line GL3 through the contacts 132*b* and 134*b*, respectively. The third connection pattern 130*c* may electrically connect the third terminal 120*c* with the fifth gate line GL5, and may be electrically connected to the third wiring 142*c* and the fifth gate line GL5 through the contacts 132*c* and 134*c*, respectively. The fourth connection pattern 130*d* may electrically connect the fourth terminal 120*d* with the second gate line GL2, and may be electrically connected to the fourth wiring 142*d* and the second gate line GL2 through the contacts 132*d* and 134*d*, respectively. The fifth connection pattern 130*e* may electrically connect the fifth terminal 120*e* with the fourth gate line GL4, and may be electrically connected to the fifth wiring 142*e* and the fourth gate line GL4 through the contacts 132*e* and 134*e*, respectively. The sixth connection pattern 130*f* may electrically connect the sixth terminal 120*f* with the sixth gate line GL6, and may be electrically connected to the sixth wiring 142*f* and the sixth gate line GL6 through the contacts 132*f* and 134*f*, respectively.

In some exemplary embodiments of the inventive concept, the gate lines GL1~GL6 and the wirings 142*a*~142*f* may be disposed in a first wiring layer (e.g., in the same layer), and the connection patterns 130*a*~130*f* may be disposed in a second wiring layer that is different from the first wiring layer. Thus, the second connection pattern 130*b* may overlap the second gate line GL2 without being electrically connected to the second gate line GL2. The fourth and fifth connection patterns 130*d* and 130*e* may overlap the third wiring 142*c* connected to the third terminal 120*c* without being electrically connected to the third wiring 142*c*. An overlapping structure of the second connection pattern 130*b* and the second gate line GL2 may correspond to the wiring overlapping region A in FIG. 3, an overlapping structure of the fourth connection pattern 130*d* and the third wiring 142*c* may correspond to the wiring overlapping region B in FIG. 3, and an overlapping structure of the fifth connection pattern 130*e* and the third wiring 142*c* may correspond to the wiring overlapping region C in FIG. 3.

For example, as illustrated in FIG. 4B, the second wiring layer may be disposed on the first wiring layer. In other words, the second and third gate lines GL2 and GL3 and the second wirings 142*b* may be formed on a substrate (e.g., a semiconductor substrate) 110, and the second connection pattern 130*b* may be formed on the second and third gate lines GL2 and GL3 and the second wirings 142*b*. The second connection pattern 130*b* may be electrically connected to the second wiring 142*b* and the third gate line GL3 by the contacts 132*b* and 134*b*. The second connection pattern 130*b* may be insulated from the second gate line GL2 by an insulation layer 150.

In some exemplary embodiments, the insulation layer 150 may include a plurality of insulation layers. For example, a first insulation layer may be formed on the substrate 100 on which the gate lines GL2 and GL3 and the wirings 142*b* are formed, and then may be partially etched to form openings. The contacts 132*b* and 134*b* may be formed by filling the openings with conductive material, and then the second connection pattern 130*b* may be formed to electrically connect the wirings 142*b* with the gate line GL3. A second insulation layer may be formed on the substrate 100 on which the second connection pattern 130*b* is formed.

Although not illustrated in FIG. 4B, each of the overlapping structure of the fourth connection pattern 130*d* and the third wiring 142*c* and the overlapping structure of the fifth connection pattern 130*e* and the third wiring 142*c* may be substantially the same as the overlapping structure of the second connection pattern 130*b* and the second gate line GL2 in FIG. 4B.

Referring to FIGS. 5A and 5B, the display panel may include the first through sixth gate lines GL1~GL6 and the first through sixth terminals 120*a*~120*f*, and may further include first, second, third, fourth, fifth and sixth connection patterns 140*a*, 140*b*, 140*c*, 140*d*, 140*e* and 140*f*, the first through sixth wirings 142*a*~142*f* and the contacts 132*a*~132*f* and 134*a*~134*f*.

The display panel of FIGS. 5A and 5B may be substantially the same as the display panel of FIGS. 4A and 4B, except that a cross-sectional structure of the gate lines GL1~GL6, the wirings 142*a*~142*f* and the connection patterns 140*a*~140*f* is changed in FIGS. 5A and 5B.

In some exemplary embodiments, as illustrated in FIG. 5B, a first wiring layer in which the gate lines GL1~GL6 and the wirings 142*a*~142*f* are disposed or formed may be disposed on a second wiring layer in which the connection patterns 140*a*~140*f* are disposed or formed. In other words, the second connection pattern 140*b* may be formed on a substrate (e.g., a semiconductor substrate) 110, and the second and third gate lines GL2 and GL3 and the second wirings 142*b* may be formed on the second connection pattern 140*b*. The second connection pattern 140*b* may be electrically connected to the second wiring 142*b* and the third gate line GL3 by the contacts 132*b* and 134*b*. The second connection pattern 140*b* may be insulated from the second gate line GL2 by an insulation layer 150.

Although FIGS. 4A, 4B, 5A and 5B illustrates examples of the wirings and the connection patterns, the wirings, the connection patterns and/or the gate lines may have one of various shapes and structures for implementing the cross-coupled structure described with reference to FIG. 3.

FIGS. 6A, 6B, 7A and 7B are diagrams for describing an operation of a display panel according to exemplary embodiments of the inventive concept.

Figure 6A:
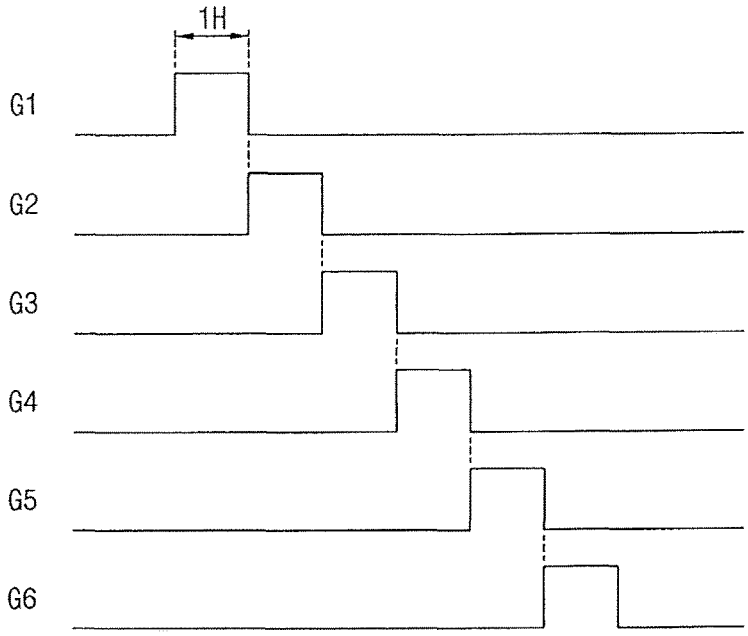
FIGS. 6A, 6B, are diagrams for describing an operation of a display panel according to exemplary embodiments of the inventive concept sequentially activated in respectively different orders of gate signals.

Referring to FIGS. 3 and 6A, in some exemplary embodiments, the first through sixth gate signals G1~G6 may be sequentially activated. As shown in the example of FIG. 6A, the order of activation is the first, second, third, fourth, fifth and sixth gate signals G1, G2, G3, G4, G5 and G6, but it should be understood that different activation orders are possible. For example, each of the first through sixth gate signals G1~G6 may have an ON level (e.g., a high level) during one horizontal period 1H. One horizontal period 1H may be defined as a duration for charging a data voltage to a pixel. When the first through sixth gate signals G1~G6 are activated as illustrated in FIG. 6A, the first through sixth pixels P11~P16 may be sequentially driven in an order of the first, third, fifth, second, fourth and sixth pixels P11, P13, P15, P12, P14 and P16 (see FIG. 3) based on the activated first through sixth gate signals G1~G6. In other words, in an example of FIG. 6A, the pixels P11, P13 and P15 that are connected to the top gate lines may be driven first, and then the pixels P12, P14 and P16 that are connected to the bottom gate lines may be driven subsequent to the top gate lines.

Figure 6B:
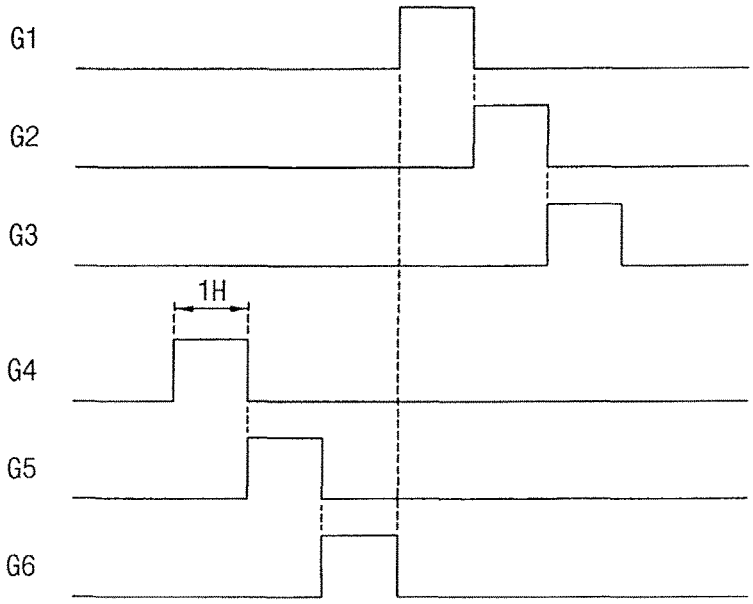

Referring to FIGS. 3 and 6B, in other exemplary embodiments, the first through sixth gate signals G1~G6 may be sequentially activated in an order of the fourth, fifth, sixth, first, second and third gate signals G4, G5, G6, G1, G2 and G3. When the first through sixth gate signals G1~G6 are activated as illustrated in FIG. 6B, the first through sixth pixels P11~P16 may be sequentially driven in an order of the second, fourth, sixth, first, third and fifth pixels P12, P14, P16, P11, P13 and P15 based on the activated first through sixth gate signals G1~G6. In other words, in the example of FIG. 6B, the pixels P12, P14 and P16 that are connected to the bottom gate lines may be driven first, and then the pixels P11, P13 and P15 that are connected to the top gate lines may be driven later.

Figure 7A:
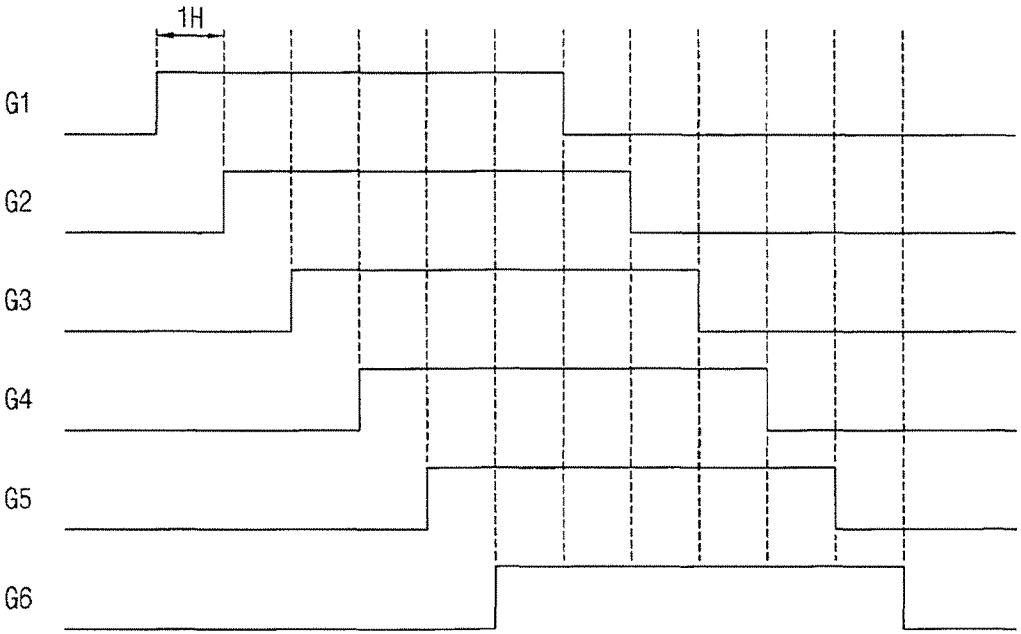
FIGS. 7A and 7B are illustrations of an operation of a display panel in accordance with FIGS. 6A & 6B with the additional operation of being based on a precharge driving scheme.
Figure 7B:
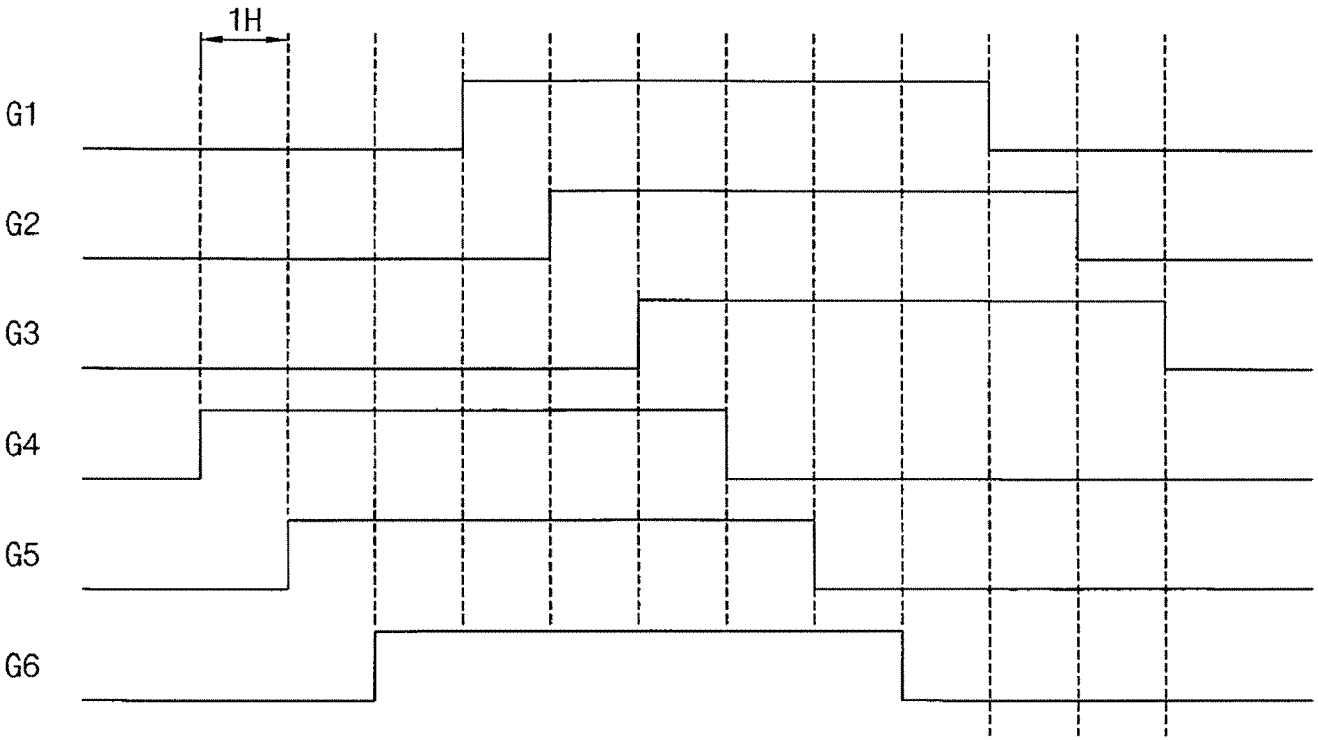

Referring to FIGS. 3, 7A and 7B, examples of FIGS. 7A and 7B may be substantially similar to the examples of FIGS. 6A and 6B, respectively, except that the examples of FIGS. 7A and 7B operate based on a precharge driving scheme. In the precharge driving scheme, a gate signal may have the ON level during at least two consecutive or successive horizontal periods to increase a charging duration and/or a charging rate. In the examples of FIGS. 7A and 7B, each of the first through sixth gate signals G1~G6 may have the ON level during six consecutive or successive horizontal periods (e.g. 6H), and activation periods of the first through sixth gate signals G1~G6 may partially overlap each other, whereas in FIGS. 6A and 6B, the sequential activation periods generally do not overlap each other.

In some exemplary embodiments of the inventive concept, the examples of FIGS. 6A and 6B may be alternately performed for each frame, or the examples of FIGS. 7A and 7B may be alternately performed for each frame. For example, during a first frame period for displaying a first frame image, the first through sixth gate signals G1~G6 may be driven as illustrated in FIG. 6A (or FIG. 7A). During a second frame period for displaying a second frame image after the first frame period, the first through sixth gate signals G1~G6 may be driven as illustrated in FIG. 6B (or FIG. 7B).

Although not illustrated in FIGS. 1, 2, 6A, 6B, 7A and 7B, the display panel according to exemplary embodiments may operate based on an inversion driving scheme in which a polarity of a data voltage applied to each pixel is reversed with respect to a common voltage per a set or predetermined period. For example, a data voltage having a first polarity (e.g., a positive polarity) may be applied to the first data line DL1, and a data voltage having a second polarity (e.g., a negative polarity) may be applied to the second data line DL2. The polarity of the data voltage applied to each data line may be changed or reversed at every frame. As the opposite potentials may generate a lateral electric field between adjacent pixels, an artisan should appreciate that techniques such as shielding to avoid a leakage light may be desirable.

FIGS. 8, 9, 10 and 11 are diagrams illustrating examples of a portion of a display panel according to exemplary embodiments of the inventive concept.

Figure 8:
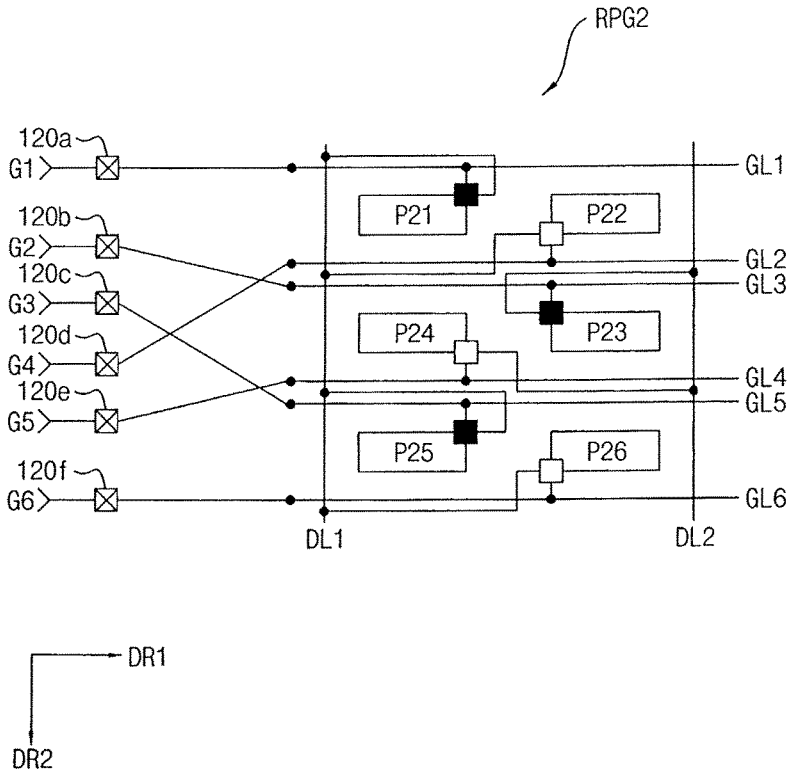
FIGS. 8, 9, 10 and 11 are diagrams illustrating respective examples of arrangements of a portion of a display panel according to exemplary embodiments of the inventive concept.

Referring to FIG. 8, a display panel may include the first through sixth gate lines GL1~GL6, the first and second data lines DL1 and DL2, first, second, third, fourth, fifth and sixth pixels P21, P22, P23, P24, P25 and P26, and first through sixth terminals 120*a*~120*f*. The first through sixth pixels P21~P26 may form a repeating pixel group RPG2.

The repeating pixel group RPG2 of FIG. 8 may be substantially the same as the repeating pixel group RPG1 of FIG. 3, except that an arrangement of the third and fourth pixels P23 and P24 is different in FIG. 8. A person or ordinary skill in the art should appreciate that the inventive concept is not limited to the arrangements of pixels in FIGS. 3 and 8.

With continued reference to FIG. 8, each of the first through sixth pixels P21~P26 may be included in a respective one pixel row and a respective one pixel column, and may be electrically connected to a respective one of the first through sixth gate lines GL1~GL6 and a respective one of the first and second data lines DL1 and DL2. For example, the first and second pixels P21 and P22 may be included in a first pixel row. The third and fourth pixels P23 and P24 may be included in a second pixel row that is adjacent to the first pixel row. The fifth and sixth pixels P25 and P26 may be included in a third pixel row that is adjacent to the second pixel row. The first, fourth and fifth pixels P21, P24 and P25 may be included in a first pixel column. The second, third and sixth pixels P22, P23 and P26 may be included in a second pixel column that is adjacent to the first pixel column. The first and second pixels P21 and P22 may be electrically connected to the first data line DL1, and may be electrically connected to the first and second gate lines GL1 and GL2, respectively. The third and fourth pixels P23 and P24 may be electrically connected to the second data line DL2, and may be electrically connected to the third and fourth gate lines GL3 and GL4, respectively. The fifth and sixth pixels P25 and P26 may be electrically connected to the first data line DL1, and may be electrically connected to the fifth and sixth gate lines GL5 and GL6, respectively.

In the repeating pixel group RPG2 of FIG. 8, the pixels P21, P23 and P25 that are connected to the top gate lines may be arranged in a zigzag shape, and the pixels P22, P24 and P26 that are connected to the bottom gate lines may be arranged in a zigzag shape. The inventive concept is not limited to the arrangement shown in FIG. 8.

Figure 9:
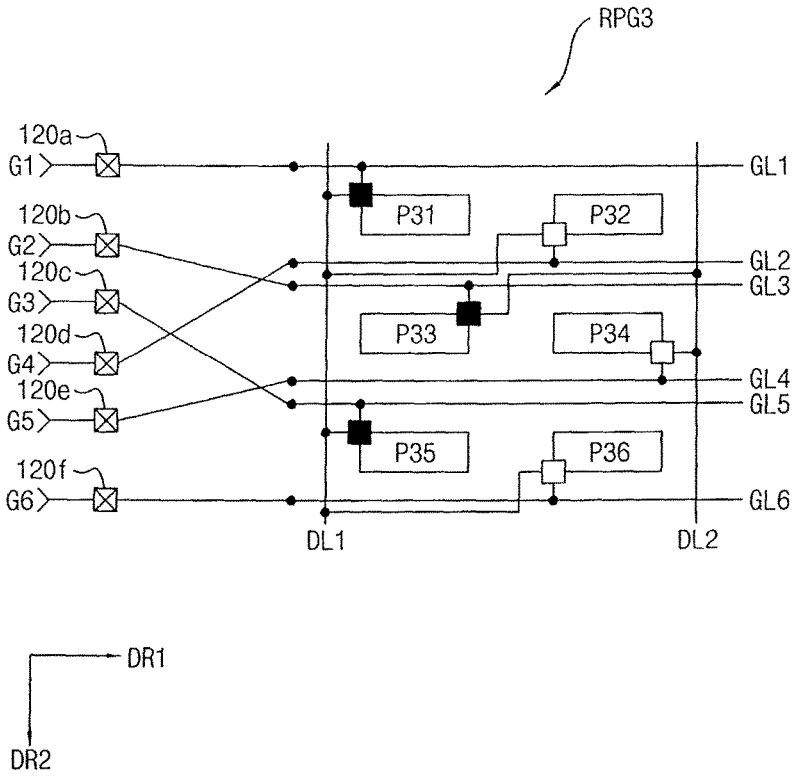

Referring to FIG. 9, a display panel may include the first through sixth gate lines GL1~GL6, the first and second data lines DL1 and DL2, an arrangement of first, second, third, fourth, fifth and sixth pixels P31, P32, P33, P34, P35 and P36, and first through sixth terminals 120*a*~120*f* that receive the gate signals G1~G6. The first through sixth pixels P31~P36 may form a repeating pixel group RPG3.

The repeating pixel group RPG3 of FIG. 9 may be substantially the same as the repeating pixel group RPG1 of FIG. 3, except that an arrangement of the switching elements (e.g., ■ and □) is changed in FIG. 9.

Switching elements (e.g., ■) of the first and fifth pixels P31 and P35 may be arranged adjacent to the first data line DL1. A switching element (e.g., □) of the fourth pixel P34 may be arranged adjacent to the second data line DL2. Although not illustrated in FIG. 9, according to exemplary embodiments, an arrangement of the switching elements (e.g., ■ and □) may be changed.

Figure 10:
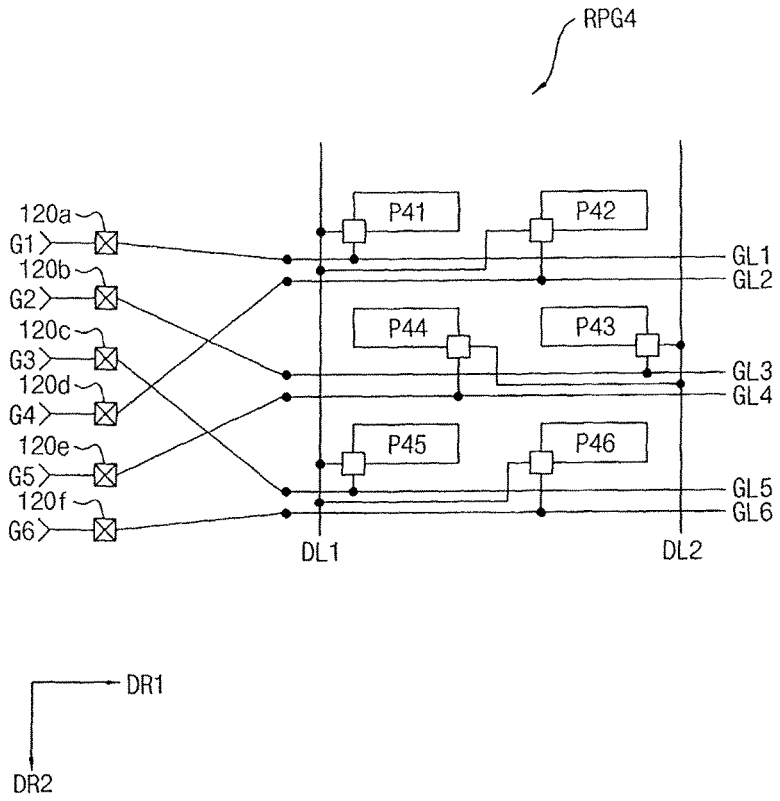

Referring to FIG. 10, a display panel may include the first through sixth gate lines GL1~GL6, the first and second data lines DL1 and DL2, first, second, third, fourth, fifth and sixth pixels P41, P42, P43, P44, P45 and P46, and first through sixth terminals 120*a*~120*f*. The first through sixth pixels P41~P46 may form a repeating pixel group RPG4.

The repeating pixel group RPG4 of FIG. 10 may be substantially the same as the repeating pixel group RPG1 of FIG. 3, except that an arrangement of the gate lines GL1~GL6 is changed in FIG. 10, and a structure of the pixels P41~P46 is changed in FIG. 10. It should be understood that the inventive concept is not limited to the arrangements shown and described herein.

Each of the first through sixth pixels P41~P46 may be included in a respective one (e.g. first) pixel row and a respective one (e.g. first) pixel column, and may be electrically connected to a respective one of the first through sixth gate lines GL1~GL6 and a respective one of the first and second data lines DL1 and DL2. For example, the first and second pixels P41 and P42 may be included in a first pixel row. The third and fourth pixels P43 and P44 may be included in a second pixel row that is adjacent to the first pixel row. The fifth and sixth pixels P45 and P46 may be included in a third pixel row that is adjacent to the second pixel row. The first, fourth and fifth pixels P41, P44 and P45 may be included in a first pixel column. Similarly, the second, third and sixth pixels P42, P43 and P46 may be included in a second pixel column that is adjacent to the first pixel column. The first and second pixels P41 and P42 may be electrically connected to the first data line DL1, and may be electrically connected to the first and second gate lines GL1 and GL2, respectively. The third and fourth pixels P43 and P44 may be electrically connected to the second data line DL2, and may be electrically connected to the third and fourth gate lines GL3 and GL4, respectively. The fifth and sixth pixels P45 and P46 may be electrically connected to the first data line DL1, and may be electrically connected to the fifth and sixth gate lines GL5 and GL6, respectively.

In some exemplary embodiments of the inventive concept, the first and second gate lines GL1 and GL2 may be disposed between the first and second pixel rows, and the third and fourth gate lines GL3 and GL4 may be disposed between the second and third pixel rows. In this example, all switching elements (e.g., □) of the first through sixth pixels P41~P46 may be connected to the bottom gate lines.

Although not illustrated in FIG. 10, according to exemplary embodiments of the inventive concept, the first and second gate lines GL1 and GL2 may be disposed at a first side (e.g., an upper side) with respect to the first pixel row, the third and fourth gate lines GL3 and GL4 may be disposed between the first and second pixel rows, and the fifth and sixth gate lines GL5 and GL6 may be disposed between the second and third pixel rows. In this example, all switching elements of the pixels may be connected to the top gate lines, as opposed to, for example, all the switching elements being connected to the bottom gate lines.

In the examples shown in FIGS. 8, 9 and 10, the first through sixth terminals 120*a*~120*f* may be connected to the first through sixth gate lines GL1~GL6 based on the examples described with reference to FIGS. 3, 4A, 4B, 5A and 5B, and the first through sixth gate signals G1~G6 may be driven based on the examples previously-described with reference to FIGS. 6A, 6B, 7A and 7B.

Figure 11:
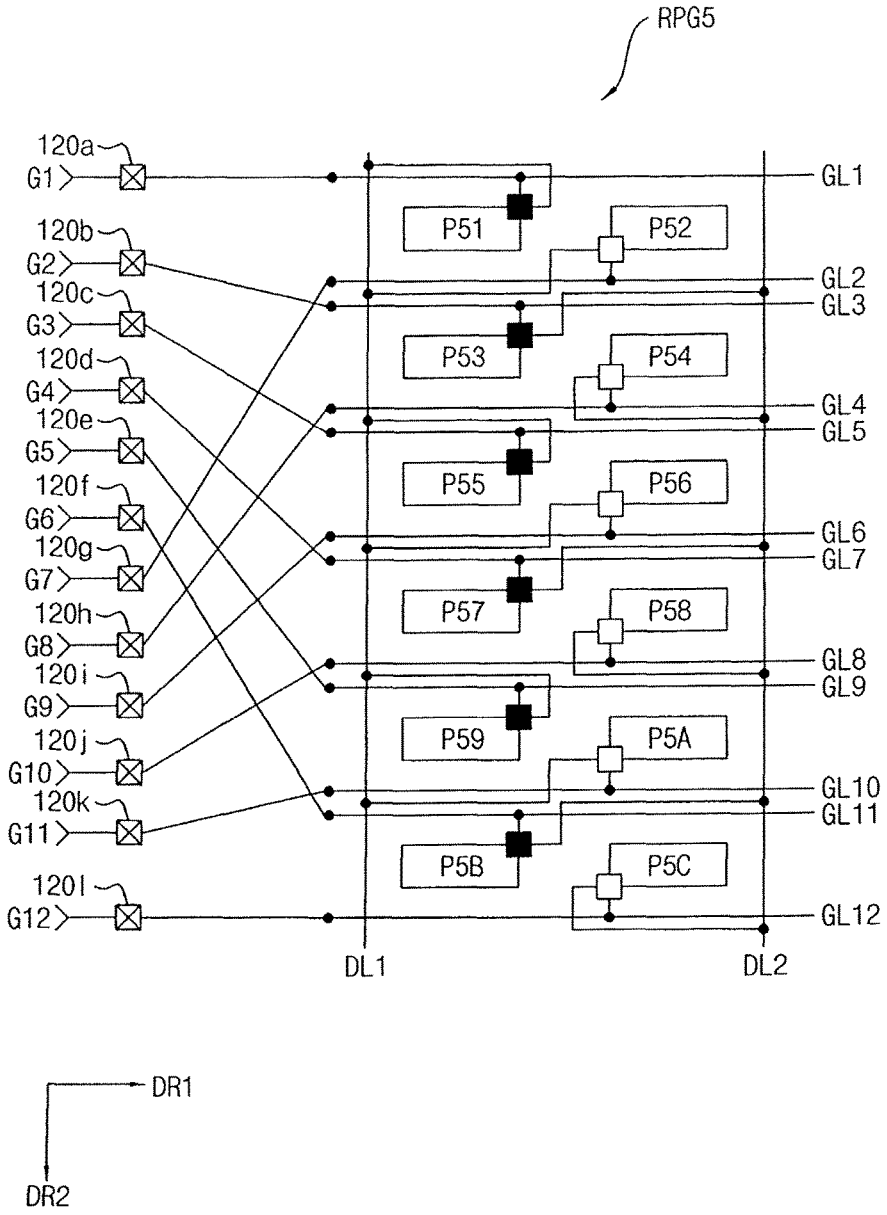

Referring to FIG. 11, a display panel may include, for example, twelve gate lines (e.g. first, second, third, fourth, fifth, sixth, seventh, eighth, ninth, tenth, eleventh and twelfth gate lines GL1, GL2, GL3, GL4, GL5, GL6, GL7, GL8, GL9, GL10, GL11 and GL12), first and second data lines DL1 and DL2, twelve pixels (e.g. first, second, third, fourth, fifth, sixth, seventh, eighth, ninth, tenth, eleventh and twelfth pixels P51, P52, P53, P54, P55, P56, P57, P58, P59 P5A, P5B and P5C), and first, second, third, fourth, fifth, sixth, seventh, eighth, ninth, tenth, eleventh and twelfth terminals 120*a*, 120*b*, 120*c*, 120*d*, 120*e*, 120*f*, 120*g*, 120*h*, 120*i*, 120*j*, 120*k*, 120*l*. The first through twelfth pixels P51~P5C may form a first repeating pixel group RPG5.

With continued reference to FIG. 11, each of the first through twelfth gate lines GL1~GL12 may extend in the first direction DR1. The first through twelfth gate lines GL1~GL12 may be sequentially arranged in the second direction DR2. Each of the first and second data lines DL1 and DL2 may extend in the second direction DR2. The first and second data lines DL1 and DL2 may be sequentially arranged in the first direction DR1.

Each of the first through twelfth pixels P51~P5C may be included in a respective one pixel row and a respective one pixel column. For example, the first and second pixels P51 and P52 may be included in a first pixel row. The first, third, fifth, seventh, ninth and eleventh pixels P51, P53, P55, P57, P59 and P5B may be included in a first pixel column.

Each of the first through twelfth pixels P51~P5C shown in FIG. 11 may be electrically connected to a respective one of the first through twelfth gate lines GL1~GL12 and a respective one of the first and second data lines DL1 and DL2. For example, connections of the first through sixth pixels P51~P56 may be substantially the same as the connections of the first through sixth pixels P11~P16 in FIG. 3. The seventh and eighth pixels P57 and P58 may be electrically connected to the second data line DL2, and may be electrically connected to the seventh and eighth gate lines GL7 and GL8, respectively. The ninth and tenth pixels P59 and P5A may be electrically connected to the first data line DL1, and may be electrically connected to the ninth and tenth gate lines GL9 and GL10, respectively. The eleventh and twelfth pixels P5B and P5C may be electrically connected to the second data line DL2, and may be electrically connected to the eleventh and twelfth gate lines GL11 and GL12, respectively.

The first through twelfth terminals 120*a*~120*l* shown in FIG. 11 may sequentially receive first, second, third, fourth, fifth, sixth, seventh, eighth, ninth, tenth, eleventh and twelfth gate signals G1, G2, G3, G4, G5, G6, G7, G8, G9, G10, G11 and G12. The first through twelfth terminals 120*a*~120*l* may be sequentially arranged in the second direction DR2.

In some exemplary embodiments of the inventive concept, the first terminal 120*a* may be connected to the first gate line GL1, the second terminal 120*b* may be connected to the third gate line GL3, the third terminal 120*c* may be connected to the fifth gate line GL5, the fourth terminal 120*d* may be connected to the seventh gate line GL7, the fifth terminal 120*e* may be connected to the ninth gate line GL9, and the sixth terminal 120*f* may be connected to the eleventh gate line GL11. The seventh terminal 120*g* may be connected to the second gate line GL2, the eighth terminal 120*h* may be connected to the fourth gate line GL4, the ninth terminal 120*i* may be connected to the sixth gate line GL6, the tenth terminal 120*j* may be connected to the eighth gate line GL8, the eleventh terminal 120*k* may be connected to the tenth gate line GL10, and the twelfth terminal 120*l* may be connected to the twelfth gate line GL12. It should be understood by a person of ordinary skill in the art that other arrangements of terminal connections than the cross-coupled structure shown in FIG. 11 are within the inventive concept.

Based on the cross-coupled structure shown in FIG. 11, the first, second, third, fourth, fifth and sixth gate signals G1, G2, G3, G4, G5 and G6 may be applied to the first, third, fifth, seventh, ninth and eleventh gate lines GL1, GL3, GL5, GL7, GL9 and GL11, respectively, and the seventh, eighth, ninth, tenth, eleventh and twelfth gate signals G7, G8, G9, G10, G11 and G12 may be applied to the second, fourth, sixth, eighth, tenth and twelfth GL2, GL4, GL6, GL8, GL10 and GL12, respectively. Similar to the first through sixth gate signals G1~G6 described with reference to FIGS. 6A, 6B, 7A and 7B, the first through twelfth gate signals G1~G12 may be sequentially activated, and then the pixels P51, P53, P55, P57, P59 and P5B that are connected to the top gate lines and the pixels P52, P54, P56, P58, PA9 and P5C that are connected to the bottom gate lines may be separately driven.

In some exemplary embodiments of the inventive concept, the cross-coupled structure in FIG. 11 may be implemented based on the examples previously-described with reference to FIGS. 4A, 4B, 5A and 5B. In some exemplary embodiments, each of the pixels P51, P52, P57 and P58 may be a red pixel, each of the pixels P53, P54, P59 and P5A may be a green pixel, and each of the pixels P55, P56, P5B and P5C may be a blue pixel. In some exemplary embodiments, the repeating pixel group RPG5 may be repeated in the first and second directions DR1 and DR2 to form the display panel according to exemplary embodiments.

The exemplary embodiments may be employed in any display panel and/or display apparatus where the plurality of gate lines GL are driven in units of 6*n. For example, the plurality of gate lines GL may include first through 6*n gate lines that are sequentially arranged in the first direction DR1, where n is a natural number equal to or greater than two. The plurality of terminals 120 may include first through 6*n terminals that sequentially receive first through 6*n gate signals among the plurality of gate signals, respectively. A k-th terminal among the first through 6*n terminals may be connected to a (2k−1)-th gate line, where k is a natural number equal to or greater than one and equal to or less than 3*n. A m-th terminal among the first through 6*n terminals is connected to a 2*(m−3n)-th gate line, where m is a natural number equal to or greater than (3n+1) and equal to or less than 6*n. Accordingly, the cross-coupled structure according to exemplary embodiments may be implemented.

The above described embodiments may be utilized in a display apparatus and/or a system including the display apparatus, for example, in a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, etc., just to name a few non-limiting examples. The foregoing is illustrative of exemplary embodiments of the inventive concept and is not to be construed as limiting thereof. Although a few exemplary embodiments have been described, those skilled in the art will readily appreciate that many modifications are possible in the exemplary embodiments without materially departing from the novel teachings and advantages of the present inventive concept. Accordingly, all such modifications are to be included within the scope of the present inventive concept as defined in the claims. Therefore, it is to be understood that the foregoing is illustrative of various exemplary embodiments and is not to be construed as limited to the specific exemplary embodiments disclosed, and that the modifications to the disclosed exemplary embodiments, as well as other exemplary embodiments, are to be included within the scope of the appended claims.

What is claimed is:

1. A display panel comprising:

a plurality of pixels arranged in a matrix including a plurality of pixel rows and a plurality of pixel columns, in which each pixel of the plurality of pixels has a short side and a long side that is longer than the short side;

a plurality of data lines extending in a first direction substantially parallel with the plurality of pixel columns along the short side of the pixels, each of the data lines is connected to at least two adjacent pixels included in a single pixel row, wherein a first pixel and a second pixel of the plurality of pixels are disposed between a first data line and second data line of the plurality of data lines, and the first pixel and the second pixel are connected to the first data line;

a plurality of gate lines extending in a second direction substantially parallel with the plurality of pixel rows, each of the gate lines connected to at least one pixel included in a single pixel row, at least two of the gate lines disposed between two adjacent pixel rows;

a gate driver configured to generate a plurality of gate signals for driving the plurality of gate lines; and a plurality of terminals configured to receive the plurality of gate signals to transmit the plurality of gate signals to the plurality of gate lines, wherein some of the plurality of terminals are connected to some of the plurality of gate lines with a cross-coupled structure.

2. The display panel of claim 1, wherein the first direction substantially parallel with the plurality of pixel columns comprises a short-side direction, and the second direction substantially parallel with the plurality of pixel rows comprises a long-side direction.

3. The display panel of claim 1, wherein the plurality of gate lines include first through 6*n gate lines that are sequentially arranged in the first direction, where n is a natural number equal to or greater than two, wherein the plurality of terminals include first through 6*n terminals that sequentially receive first through 6*n gate signals among the plurality of gate signals, respectively, wherein a k-th terminal among the first through 6*n terminals is connected to a (2k−1)-th gate line, where k is a natural number equal to or greater than one and equal to or less than 3*n, and wherein a m-th terminal among the first through 6*n terminals is connected to a 2*(m−3n)-th gate line, where m is a natural number equal to or greater than (3n+1) and equal to or less than 6*n.

4. The display panel of claim 1, wherein the plurality of pixels are disposed in a display region of the display panel, and wherein the gate driver and the plurality of terminals are disposed in a peripheral region surrounding the display region of the display panel.

5. A display panel comprising:

a plurality of pixels arranged in a matrix including a plurality of pixel rows and a plurality of pixel columns, in which each pixel of the plurality of pixels has a short side and a long side that is longer than the short side;

a plurality of data lines extending in a first direction substantially parallel with the plurality of pixel columns along the short side of the pixels, each of the data lines is connected to at least two adjacent pixels included in a single pixel row;

a plurality of gate lines extending in a second direction substantially parallel with the plurality of pixel rows, each of the gate lines connected to at least one pixel included in a single pixel row, at least two of the gate lines disposed between two adjacent pixel rows;

a gate driver configured to generate a plurality of gate signals for driving the plurality of gate lines; and a plurality of terminals configured to receive the plurality of gate signals to transmit the plurality of gate signals to the plurality of gate lines, wherein some of the plurality of terminals are connected to some of the plurality of gate lines with a cross-coupled structure, wherein the plurality of gate lines include first, second, third, fourth, fifth and sixth gate lines that are sequentially arranged in the first direction, wherein the plurality of terminals include first, second, third, fourth, fifth and sixth terminals that sequentially receive first, second, third, fourth, fifth and sixth gate signals among the plurality of gate signals, respectively, and wherein the first terminal is connected to the first gate line, the second terminal is connected to the third gate line, the third terminal is connected to the fifth gate line, the fourth terminal is connected to the second gate line, the fifth terminal is connected to the fourth gate line, and the sixth terminal is connected to the sixth gate line.

6. The display panel of claim 5, further comprising:

a first connection pattern connecting the first terminal with the first gate line;

a second connection pattern connecting the second terminal with the third gate line;

a third connection pattern connecting a wiring that is connected to the third terminal with the fifth gate line;

a fourth connection pattern connecting the fourth terminal with the second gate line;

a fifth connection pattern connecting the fifth terminal with the fourth gate line; and a sixth connection pattern connecting the sixth terminal with the sixth gate line, wherein the second connection pattern overlaps the second gate line, and the fourth and fifth connection patterns overlap the wiring connected to the third terminal.

7. The display panel of claim 5, wherein the plurality of pixels include:

first and second pixels adjacent to each other, included in a first pixel row among the plurality of pixel rows, and connected to the first and second gate lines, respectively;

third and fourth pixels adjacent to each other and adjacent to the first and second pixels, included in a second pixel row adjacent to the first pixel row among the plurality of pixel rows, and connected to the third and fourth gate lines, respectively; and fifth and sixth pixels adjacent to each other and adjacent to the third and fourth pixels, included in a third pixel row adjacent to the second pixel row among the plurality of pixel rows, and connected to the fifth and sixth gate lines, respectively.

8. The display panel of claim 7, wherein, during a first frame period for displaying a first frame image, the first through sixth gate signals are sequentially activated in an order of the first, second, third, fourth, fifth and sixth gate signals, and the first through sixth pixels are sequentially driven in an order of the first, third, fifth, second, fourth and sixth pixels based on the activated first through sixth gate signals.

9. The display panel of claim 8, wherein activation periods of the first through sixth gate signals partially overlap each other.

10. The display panel of claim 8, wherein, during a second frame period for displaying a second frame image after the first frame period, the first through sixth gate signals are activated in a sequence of the fourth, fifth, sixth, first, second and third gate signals, and the first through sixth pixels are driven in a sequence of the second, fourth, sixth, first, third and fifth pixels based on the sequentially activated first through sixth gate signals.

11. The display panel of claim 8, wherein the first through sixth gate signals have an ON level during at least two consecutive or successive horizontal periods, and activation periods of the first through sixth gate signals partially overlap each other.

12. The display panel of claim 7, wherein the second and third gate lines are disposed between the first and second pixel rows, and wherein the fourth and fifth gate lines are disposed between the second and third pixel rows.

13. The display panel of claim 7, wherein the first and second gate lines are disposed between the first and second pixel rows, and wherein the third and fourth gate lines are disposed between the second and third pixel rows.

14. The display panel of claim 7, wherein the plurality of data lines include first and second data lines that are adjacent to each other, wherein the first, second, fifth and sixth pixels are connected to the first data line, and the third and fourth pixels are connected to the second data line.

15. A display apparatus comprising:

a gate driver configured to generate a plurality of gate signals; and a display panel connected to the gate driver, the display panel comprising:

a plurality of pixels arranged in a matrix including a plurality of pixel rows and a plurality of pixel columns;

a plurality of data lines extending in a first direction parallel with the plurality of pixel columns, each of the data lines connected to at least two adjacent pixels included in a single pixel row, wherein a first pixel and a second pixel of the plurality of pixels are disposed between a first data line and second data line of the plurality of data lines, and the first pixel and the second pixel are connected to the first data line;

a plurality of gate lines extending in a second direction parallel with the plurality of pixel rows and driven by the plurality of gate signals, each of the gate lines connected to at least one pixel included in a single pixel row, at least two of the gate lines disposed between two adjacent pixel rows; and a plurality of terminals configured to receive the plurality of gate signals to transmit the plurality of gate signals to the plurality of gate lines, wherein some of the plurality of terminals are connected to some of the plurality of gate lines with a cross-coupled structure.

16. The display apparatus of claim 15, wherein each of the plurality of pixels includes a short side, and a long side substantially perpendicular to the short side which is longer than the short side, and wherein the first direction parallel with the plurality of pixel columns comprises a short-side direction of the plurality of pixels, and the second direction parallel with the plurality of pixel rows comprises a long-side direction of the pixels.

17. The display apparatus of claim 15, wherein the plurality of gate lines include first, second, third, fourth, fifth and sixth gate lines that are sequentially arranged in the first direction, wherein the plurality of terminals include first, second, third, fourth, fifth and sixth terminals that sequentially receive first, second, third, fourth, fifth and sixth gate signals among the plurality of gate signals, respectively, and wherein the first terminal is connected to the first gate line, the second terminal is connected to the third gate line, the third terminal is connected to the fifth gate line, the fourth terminal is connected to the second gate line, the fifth terminal is connected to the fourth gate line, and the sixth terminal is connected to the sixth gate line.

18. The display apparatus of claim 17, wherein the display panel further includes:

a first connection pattern connecting the first terminal with the first gate line;

a second connection pattern connecting the second terminal with the third gate line;

a third connection pattern connecting a wiring connected to the third terminal with the fifth gate line;

a fourth connection pattern connecting the fourth terminal with the second gate line;

a fifth connection pattern connecting the fifth terminal with the fourth gate line; and a sixth connection pattern connecting the sixth terminal with the sixth gate line, wherein the second connection pattern overlaps the second gate line, and the fourth and fifth connection patterns overlap the wiring connected to the third terminal.

19. The display apparatus of claim 17, wherein the plurality of pixels include:

first and second pixels adjacent to each other, included in a first pixel row among the plurality of pixel rows, and connected to the first and second gate lines, respectively;

third and fourth pixels adjacent to each other, adjacent to the first and second pixels, included in a second pixel row adjacent to the first pixel row among the plurality of pixel rows, and connected to the third and fourth gate lines, respectively; and fifth and sixth pixels adjacent to each other, adjacent to the third and fourth pixels, included in a third pixel row adjacent to the second pixel row among the plurality of pixel rows, and connected to the fifth and sixth gate lines, respectively.

20. A display panel comprising:

a plurality of pixels in which each pixel has a first side comprising a short-side and a second side comprising a long-side substantially perpendicular to the short side, the plurality of pixels arranged in a matrix including a plurality of pixel rows and a plurality of pixel columns;

a plurality of data lines extending substantially parallel to a short-side direction of the pixels, and each of the data lines is connected to at least two adjacent pixels in one of the plurality of pixel rows; and a plurality of gate lines extending substantially parallel to a long-side direction of the pixels, each of the gate lines is connected to at least one pixel included in a single pixel row, and at least two of the gate lines are disposed between two adjacent pixel rows;

a plurality of terminals, wherein the plurality of gate lines includes first, second, third, fourth, fifth and sixth gate lines that are sequentially arranged in the short-side direction, wherein the plurality of terminals include first, second, third, fourth, fifth and sixth terminals sequentially arranged in the short-side direction, and wherein the first terminal is connected to the first gate line, the second terminal is connected to the third gate line, the third terminal is connected to the fifth gate line, the fourth terminal is connected to the second gate line, the fifth terminal is connected to the fourth gate line, and the sixth terminal is connected to the sixth gate line.

* * * * *